US008585961B2

(12) United States Patent
Galewski

(10) Patent No.: US 8,585,961 B2
(45) Date of Patent: Nov. 19, 2013

(54) PREHEATERS FOR PREHEATING STEELMAKING LADLES

(75) Inventor: Gregory S. Galewski, Dyersburg, TN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 13/401,292

(22) Filed: Feb. 21, 2012

(65) Prior Publication Data

US 2012/0146267 A1 Jun. 14, 2012

Related U.S. Application Data

(62) Division of application No. 12/137,420, filed on Jun. 11, 2008, now Pat. No. 8,142,541.

(60) Provisional application No. 60/943,146, filed on Jun. 11, 2007.

(51) Int. Cl.
*C21C 5/46* (2006.01)
*F27B 14/14* (2006.01)

(52) U.S. Cl.
USPC ..... 266/81; 266/218; 266/223; 266/287; 432/248; 432/250

(58) Field of Classification Search
USPC ..... 266/287, 81, 218, 223; 432/248, 250
See application file for complete search history.

(56) References Cited

U.S. PATENT DOCUMENTS

| | | | | |
|---|---|---|---|---|
| 3,155,142 | A * | 11/1964 | Stack | 431/328 |
| 3,840,323 | A | 10/1974 | Eckerle et al. | |
| 3,863,907 | A * | 2/1975 | Pierson et al. | 266/236 |
| 4,462,698 | A | 7/1984 | Ely | |
| 4,718,643 | A | 1/1988 | Gitman | |
| 5,981,917 | A | 11/1999 | Groth et al. | |
| 6,540,957 | B1 | 4/2003 | Hara et al. | |
| 2010/0314809 | A1 | 12/2010 | Schluter et al. | |

FOREIGN PATENT DOCUMENTS

| | | |
|---|---|---|
| JP | 06071421 | 3/1994 |
| JP | 06106333 | 4/1994 |
| KR | 100306593 | 10/2001 |
| KR | 200295670 | 2/2003 |

OTHER PUBLICATIONS

International Search Report for PCT/US2008/066591 mailed Dec. 12, 2008.

* cited by examiner

*Primary Examiner* — Roy King
*Assistant Examiner* — Tima M McGuthry Banks
(74) *Attorney, Agent, or Firm* — Moore & Van Allen PLLC; Jeffrey R. Gray

(57) ABSTRACT

Embodiments of the invention comprise a preheater for preheating a ladle for use in steelmaking wherein less fuel is consumed in heating the ladle efficiently and accurately to a controlled temperature. A preheater temperature is varied by controlling a burner of the heating unit based on measurements of refractories of the ladle taken by a pyrometer. The heating unit of the preheater includes an emissive coating for reducing heat loss and efficient heating during the preheating process. The heating unit of the preheater also includes valve mechanisms for accurately varying a flame size of the burner by regulating the rate of fuel, air, and oxygen supplied to the heating unit.

20 Claims, 2 Drawing Sheets

PREHEATERS FOR PREHEATING STEELMAKING LADLES

CROSS-REFERENCE TO RELATED APPLICATION

The present application was filed as a divisional application of U.S. patent application Ser. No. 12/137,420 filed on Jun. 11, 2008, which claims priority from U.S. provisional patent application No. 60/943,146 filed on Jun. 11, 2007, and which issued into U.S. Pat. No. 8,142,541 on Mar. 27, 2012, the entire disclosures of which are hereby incorporated by reference.

BACKGROUND AND SUMMARY OF INVENTION

The invention relates generally to steelmaking and, more particularly, to a method of and apparatus for preheating steelmaking ladles. As noted in U.S. Pat. No. 5,981,917, in steelmaking brick or cast refractory-lined ladles are used to hold the molten steel during steelmaking from an iron source, e.g., in an electric arc furnace, and to transport the molten steel to the next stage in steel processing, such as a continuous caster. These ladles may be large enough to hold 30 to 200 tons, or more, of molten steel. Since steelmaking is typically carried out continuously, several ladles are rotated through the melt shop and casting shop simultaneously. There are also generally ladles which are off line in reserve and for repair and maintenance.

The thermal state of the ladles has a direct and significant impact on the length of the campaign in making the steel. The refractories of the ladle must be heated to the same temperature, typically about 2700 to 2900 degrees F., as the molten steel in it. The ladles even when direct recycled through the melt and casting shops will cool as the molten steel is discharged into the caster, and cool farther before the ladle is returned for recharging in the melt shop. Moreover, if ladles are taken off line in the steelmaking cycle, they typically cool to ambient temperatures, and the replacement ladles have to be heated from ambient temperature to operating temperature. In any case, ladles may be preheated to reduce the length of the campaign during steelmaking and increase the steelmaking capacity of the melt shop and the entire steelmaking facility.

In short, steelmaking ladles must be heated up when filled with molten metal because of the heat absorbed from the melt by the ladle refractory lining. On the other hand, the ladles cool down when empty. Moreover, the length of time during which a ladle is empty is highly variable and unpredictable. Delays due to a major ladle repair take many hours to complete and result in a cold ladle. If used in that condition, the steelmaking campaign will be considerably lengthened since the ladles must be heated with the molten metal to steelmaking temperature. Further, the temperature may be critical to the casting operation as molten steel may need to be introduced into the caster tundish at controlled temperature near liquidus metal temperature, say about 40 degrees F. above the liquidus metal temperature. Thus, it is quite significant to operating capacity and the energy efficiency of the steelmaking plant that the heating and heat loss of ladles be closely controlled.

As a result, preheating of ladles before charging in the melt shop has become a common practice. Particularly, ladle preheating served to reduce damage to ladles taken out of the rotational cycle for repair and maintenance and for ladles first introduced into use. In any event, preheating reduced thermal stresses in the ladle refractory, and reduced the length of steelmaking campaigns and correspondingly increased the capacity of the steelmaking plant. However, overheating of preheated ladles also occurred which resulted in costly energy losses and resulted in unwanted and expensive refractory damage.

Usually preheating of ladles was performed with a gas-fired burner which injected a combustion flame into the interior of the ladle. Gas-fired ladle preheaters are represented, for example, by U.S. Pat. Nos. 4,359,209; 4,229,211; 4,014,532, and 3,907,260. Such a preheating apparatus may preheat the ladle to a desired temperature such as a temperature between 1800 degrees F. and 2000 degrees F. The current temperature of the ladle during the preheating process was often measured and controlled using a thermocouple (see, e.g., U.S. Pat. No. 4,718,643) or pyrometer (see, e.g., U.S. Pat. No. 4,462,698). As a result, conventional ladle preheating processes have involved consumption of large amounts of fuel, such as natural gas, and have resulted in damage to the refractories from overheating.

Accordingly, there is an unmet need for a method to reduce the amount of fuel consumed during preheating of the ladle refractories for use in steelmaking, and also to preheat the refractories of the ladle to a desired temperature efficiently while inhibiting damage and wear of the refractories from overheating.

Disclosed is a method of preheating a steelmaking ladle having an open upper portion and inner refractory surfaces. The method comprising the steps of:

(a) positioning a preheater having a radiant reflective surface and at least one burner adjacent the open upper portion of the steelmaking ladle where the reflective surface comprises an emissive coating;

(b) heating the inner refractory surfaces of the steelmaking ladle to a desired temperature by combustion through the burner of the preheater where the emissive coating of the reflective surface facilitates preheating of the steelmaking ladle;

(c) positioning a pyrometer to measure a representative temperature of the inner refractory surfaces of the steelmaking ladle during heating;

(d) generating electrical signals indicative of the representative temperature of the inner refractory surfaces of the steelmaking ladle measured by the pyrometer; and (e) controlling the temperature of the heating by the preheater of the inner refractory surfaces of the steelmaking ladle using the electrical signals generated by the pyrometer.

The method of preheating a steelmaking ladle may have the open upper portion of the steelmaking ladle positioned substantially opposite the reflective surface with the emissive coating of the preheater, and the reflective surface may substantially cover the open upper portion of the steelmaking ladle. Also, a gap of no more than 8 inches or 3 inches may be maintained between the reflective surface of the preheater and the open upper portion of the steelmaking ladle.

The emissive coating used in the method of ladle preheating may be disposed on a refractory surface of the preheater, and the refractory surface may substantially cover the open upper portion of the steelmaking ladle. The emissive coating may have an emissivity greater than 0.85 or 0.90, or may be between 0.85 and 0.95.

The emissive coating used in the method of ladle preheating may be a silicide coating. Further, the silicide coating may be selected from the group consisting of molybdenum silicide, tantalum silicide, niobium silicide or a combination thereof.

Disclosed is a method of preheating steelmaking ladles using a heating unit with a burner. The method comprising the additional step of regulating a flow rate of fuel to the burner during an idle state of the burner between preheating cycles, where the flow rate of the fuel is set to no higher than 600 SCFH during the idle state.

Disclosed is a method of preheating steelmaking ladles using a heating unit with a burner. The method comprising the additional step of regulating a flow rate of fuel to the burner during an idle state of the burner between preheating cycles, where the heating unit includes a direct drive throttle valve for regulating the flow rate of the fuel to the burner.

Numerous additional advantages and features will become readily apparent from the following detailed description of exemplary embodiments, from the claims and from the accompanying drawings.

DESCRIPTION OF THE DRAWINGS

The accompanying drawings illustrate preferred embodiments of the present disclosure, in which.

DETAILED DESCRIPTION OF THE DISCLOSURE

Shown in the accompanying drawings is a detailed description of specific embodiment of the invention, with the understanding that the present disclosure is to be considered as exemplifying the principles of the general inventive concept described in the patent claims.

Figure 1:
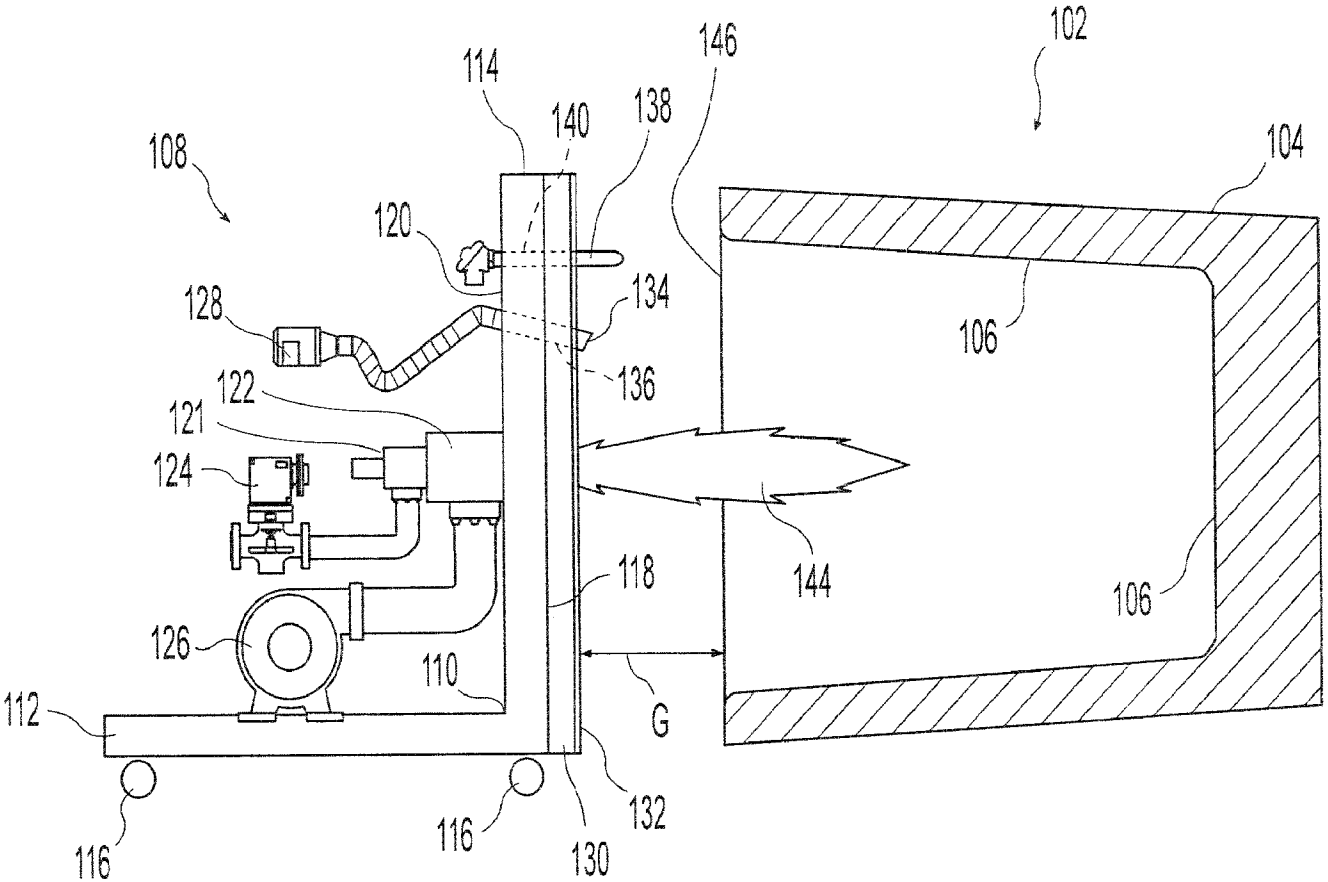
FIG. 1 is a schematic drawing showing a ladle and a preheater for use in a method of preheating steelmaking ladles.

As shown in FIG. 1, a steelmaking ladle 102 (hereinafter "ladle") for containing molten metal (e.g., molten steel) has a shell or body 104 wherein a refractory lining 106 is provided to contain molten metal during steelmaking. The refractories 106 of the ladle 102 may be refractory bricks lining an inner surface of the body 104 of the ladle 102. In an alternative embodiment, the refractories 106 of the ladle 102 are formed as a cast lining of the ladle 102.

Figure 2:
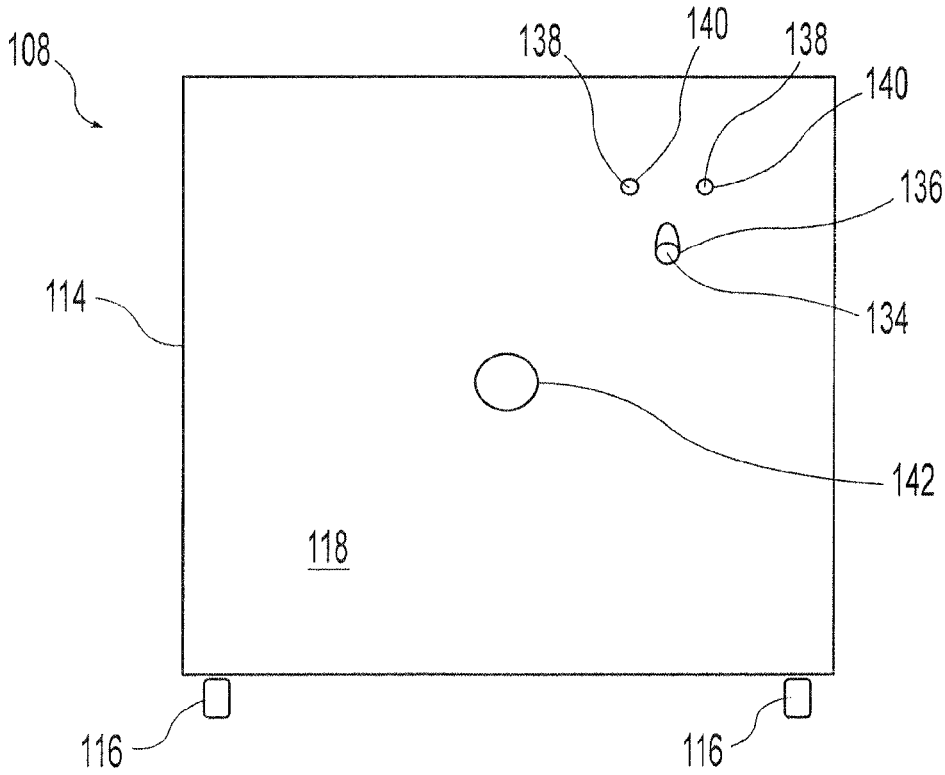
FIG. 2 is a front side elevational view of the preheater of FIG. 1.

With reference to FIGS. 1 and 2, a preheater 108 includes a frame or body 110 including a base portion 112 and a wall portion 114, where the base portion 112 and the wall portion 114 are lateral to one another. The base portion 112 of the preheater 108 may include wheels or rollers 116 to facilitate movement of the preheater 108 to a desired location. The wall portion 114 of the preheater 108 has opposing surfaces forming a first side 118 and a second side 120.

The preheater 108 also includes a burner 122 (e.g., a natural gas burner), a fuel unit 124 connected to a fuel source (not shown), an air intake unit 126 connected to an air source (not shown), and a pyrometer 128 connected to a control system (not shown). These components may be but are not necessarily disposed as shown in FIG. 1 above the base portion 112 and on the second lateral side 120 of the wall portion 114 of the frame 110 of the preheater 108.

The fuel unit 124 includes a servo valve or other control mechanism for regulating the flow rate of fuel (e.g., natural gas) from the fuel source to the burner 122. The air intake unit 126 also includes a servo valve or other control mechanism for regulating the flow rate of air from the air source to the burner 122. A control unit, for example a programmable logic controller (PLC), interfaces with the fuel unit 124 and the air intake unit 126 to control the respective flow rates of air and fuel to this burner. The control unit is connected to receive the electrical signals from the pyrometer 128 representative of the temperature movement of the refractories 106 in the ladle 104, so that the control unit controls the fuel unit 124 and the air intake unit 126 based on a temperature of the refractories 106 of the ladle 102 as measured by the pyrometer 128.

A refractory material 130 (e.g., formed from refractory bricks) is disposed on the first side 118 of the wall portion 114 of the preheater 108. Then, an emissive coating 132 having high emissivity above 0.85 is applied on the refractory material 130 to form a radiant reflective surface. The emissive coating 132 may be a silicide coating and may be a silicide coating selected from the group consisting of molybdenum silicide, tantalum silicide, and niobium silicide. The emissive coating may have an emissivity of at least 0.90, and may have an emissivity between 0.85 and 0.95.

The pyrometer 128 may be coupled to a tube 134 (e.g., a flexible fiber optic tube) that extends through an opening 136 in the wall portion 114 of the preheater 108 (i.e., from the second side 120 to the first side 118 of the wall portion 114), in the refractory material 130 adhering to the first side 118 of the wall portion 114. The opening 136 in the emissive coating 132 forming the radiant reflective surface on the refractory material 130 provides a line of sight for the pyrometer 128 to measure the temperature of the refractories 106 of the ladle 102. Similarly, if other temperature sensing devices such as thermocouples 138 are used during the preheating process, the thermocouples 138 may be positioned through openings 140 in the wall portion 114, the refractory material 130, and the emissive coating 132, but these are operative, if used, only as back-up to the presently described method, as described below.

Referring particularly to FIG. 2, an opening 142 also extends through the wall portion 114 of the preheater 108 (i.e., from the second side 120 to the first side 118 of the wall portion 114), through the refractory material 130 adhering to the first side 118 of the wall portion 114, and through the emissive coating 132 forming the radiant reflective surface on the refractory material 130. The opening 142 may allow a flame 144 from the burner 122 to pass through the wall portion 114 or the burner 122 itself. In preheating the ladle 102, the upper portion of the ladle 102 is positioned relative to the radiant reflective surface of preheater 108 (separated by a gap G) such that the flame 144 from the preheater 108 enters the ladle 102 through an open upper portion 146 of the ladle 102 (see FIG. 1). Heat from the flame 144 preheats the ladle 102 including its refractories 106.

In operation, the pyrometer 128 measures the surface temperature of the refractories 106 of the ladle 102 during the preheating of the ladle 104. In this manner, the heat output by the burner 122 is controlled by regulating the fuel feed rate and air input rate by the control unit, based on temperature data from the pyrometer 128. By controlling the burner 122 based on the temperature of the refractories 106 of the ladle 102, as opposed for example to a temperature of the air exhausted from the preheater 108, or thermocouples 138, improved fuel consumption control is achieved, particularly during the early stages when the temperature difference is largest and during the latter phases of the preheating process when overheating of the refractories 106 is at risk. Temperature readings by the pyrometer 128 provide an instant and direct measure of the refractory temperatures in the ladle. The thermocouple in contrast is measuring heat conduction from the refractories 106, and is subject to delay and inaccuracies.

By way of trials to confirm the operation of the present ladle preheat method, five preheat units were studied to confirm a fuel consumption efficiency and ladle refractory heating control by the presently claimed matter. Two of the preheat units were equipped with Williamson brand Pro series pyrometers, with each pyrometer providing process variable feedback to the temperature control function of the preheat unit's respective programmable logic controller (PLC). Of the remaining three preheat units, one was out of service, and the other two performed temperature control using type K thermocouples.

Each of the preheat units was equipped with meters to measure gas, oxygen and air flow. Automated control valves were used to regulate these flows using a Siemens S7 PLC. Fuel consumption was tracked using a totalizing program in the PLC of each preheat unit. Daily totals were recorded for all fuel consumed and fuel consumed while regulating temperature, as well as the number of hours per day spent operating in ladle preheating control. The difference between these two fuel consumptions was logged as fuel consumed maintaining an idle flame. Fuel consumed while regulating was averaged over the hours per day spent in ladle preheat control, which generated a usage rate in Standard Cubic Feet per Hour (SCFH).

By recording fuel consumption rates, it was found that the efficiency of the preheat operation varied based on the amount of distance, "gapG" shown in FIG. 1, between the open end of the ladle and the radiant reflective surface of the preheat unit. This variance was confirmed on all of the preheat units tested. As a result, 8 inches of gap was established as dimension G between the radiant reflective surface and the upper ladle opening. It is believed further preheating efficiency can be achieved by reducing this gap to 3 inches.

Usage rates over an initial 67 day study averaged 8,456 SCFH for thermocouple control as recorded on days when the gap G was 8 inches or less. Usage rates over the same initial 67 day period averaged 7,040 SCFH for pyrometer control as recorded on days when gap was 8 inches or less. This represents a 17% reduction in fuel consumption for the present preheating method when the gap was 8 inches or less. (see Row 1 of Table 1 below).

TABLE 1

Average Preheater Fuel Consumption Rate by Gap, Thermocouple Temperature Control vs. Pyrometer Temperature Control

| | Preheat Units Using Thermocouple Temperature Control: Average SCFH | Preheat Units Using Pyrometer Temperature Control: Average SCFH | Approximate Percent Savings In Fuel Consumption |
|---|---|---|---|
| ≤8 inch Gap | 8456 | 7040 | 17% |
| ≥8 inch Gap | 10229 | 9685 | 5% |

The consumption rates were also recorded on days when the gap G between ladle and radiant reflective surface was at a distance of greater than 8 inches. Under these circumstances usage rates averaged 10,229 SCFH for thermocouple temperature control, and 9,685 SCFH for pyrometer temperature control. This achieved a 5% reduction in fuel consumption for the present method of ladle preheating (see Row 2 of Table 1 above).

Accordingly, it was concluded that the fuel savings trend over the two plus months were substantial under all conditions with the present method of preheating steelmaking ladles.

This reduction in fuel consumption was the result of the combination in the present preheat method of the pyrometer temperature control and emissive coating 132 on the reflective surface of the preheater 108. As noted above, the emissive coating 132 forming the radiant reflective surface on the refractory material 130 disposed on the first side 118 of the wall portion 114 of the preheater 108. In this manner, the emissive coating 132 forming the reflective surface is spaced from the open upper portion 146 of the ladle 102 by the gap G and substantially covers the open upper portion 146 of the ladle 102 during preheating of the ladle 102 (see FIG. 1). The emissive coating 132 reduces fuel consumption by reflecting radiant heat energy back into the ladle and improving the efficiency of the preheat system in preheating the temperature in the ladle. The emissive coating 132 reduces fuel consumption by re-emitting radiant heat from the radiant reflective surface back onto the refractories 106 of the ladle 102 being preheated and also by reducing heat loss during the preheating process.

Emissive coatings absorb and re-radiate energy away from the refractory surface of a preheat unit. The relationship of this energy transfer is demonstrated by Equation 1 below, where Q=reradiated energy (BTU/hr.-ft$^2$); $E_w$=emissivity of the coating; δ=Stefan-Boltzmann constant; $T_C$=coating temperature; and $T_L$=load temperature.

$$Q=E_w*\delta*(T_C^4-T_L^4) \quad \text{Equation 1}$$

As the relationship of coating temperature to load temperature is to the fourth power, the emissive coatings is greatest when differential temperature is high. As a result, the present method provides a relatively short duration of preheating cycles of from 20 minutes to 2 hours.

By way of analysis, baseline fuel (e.g., natural gas) consumption data was gathered from all five of the preheat units (numbered 1-5) in preparation for emissive coating trials. This baseline data, as well as trial data was recorded without regard to gap distance between the ladles and the preheat units.

The preheat unit number 1 was resurfaced with new refractory material and then coated by Emisshield (a registered trademark of Wessex, Inc.) brand emissive coating to form the radiant reflective surface. Fuel consumption rates on this preheat unit were recorded and compared to fuel consumption rates obtained prior to application of the emissive coating. Comparisons to fuel consumption rates for the other four preheat units were also made.

Here again, the presently claimed method of preheating ladles showed substantial fuel consumption efficiency. After application of the emissive coating, the average gas consumption rate for preheat unit number 1 was 5,278 SCFH while preheating a ladle. Compared to baseline data for this preheat unit of 7,535 SCFH, a 30% reduction in fuel consumption was realized. Further, comparing the data recorded for the other four non-coated preheat units of 8,235 SCFH, a 35% reduction in fuel consumption was projected by use of the present preheat method.

Preheat units 2 and 3 were then coated with ITC-100 brand emissive coating produced by International Technical Ceramics, Inc. and supplied by Vesuvius Co. With these two preheat units, the emissive coating forming the radiant reflective surface was applied over the existing, worn refractory surface, and not over a new refractory surface as was the case with the preheat unit 1. Fuel consumption rates on these preheat units were then recorded and compared to the fuel consumption rates prior to application of the emissive coating.

Fuel consumption efficiency again increased after application of the ITC-100 coating material. At approximately three weeks into the trial, preheat unit 2 showed a reduction from baseline data of 7,912 SCFH to 7,582 SCFH for an increased efficiency of 4%. Preheat unit 3 showed a reduction from baseline data of 9,045 SCFH to 8,259 SCFH for an increased efficiency of 9%. At this point in the trial, preheat units 2 and 3 were recoated with the Emisshield brand emissive coating in conjunction with the planned application of the Emisshield emissive coating to preheat units 4 and 5 to form the radiant reflective surface.

Preheat units 2, 3, 4, and 5 were coated with the Emisshield emissive coating to form the radiant reflective surface over the existing, worn refractory surface. Fuel consumption data continued to be recorded for all five preheat units. Preheat units 2 and 3 improved their fuel efficiency from 4% and 9%, with the ITC-100 coating, to 12% and 13%, respectively, with the Emisshield emissive coating, using the same baseline data. Preheat unit 4 had realized a reduction from baseline data of 8,260 SCFH to 7,392 SCFH for an increase in fuel efficiency of 11%. Preheat unit 5 had realized a reduction from baseline data of 8,881 SCFH to 7,954 SCFH for an increase in fuel efficiency of 10%.

Figure 3:
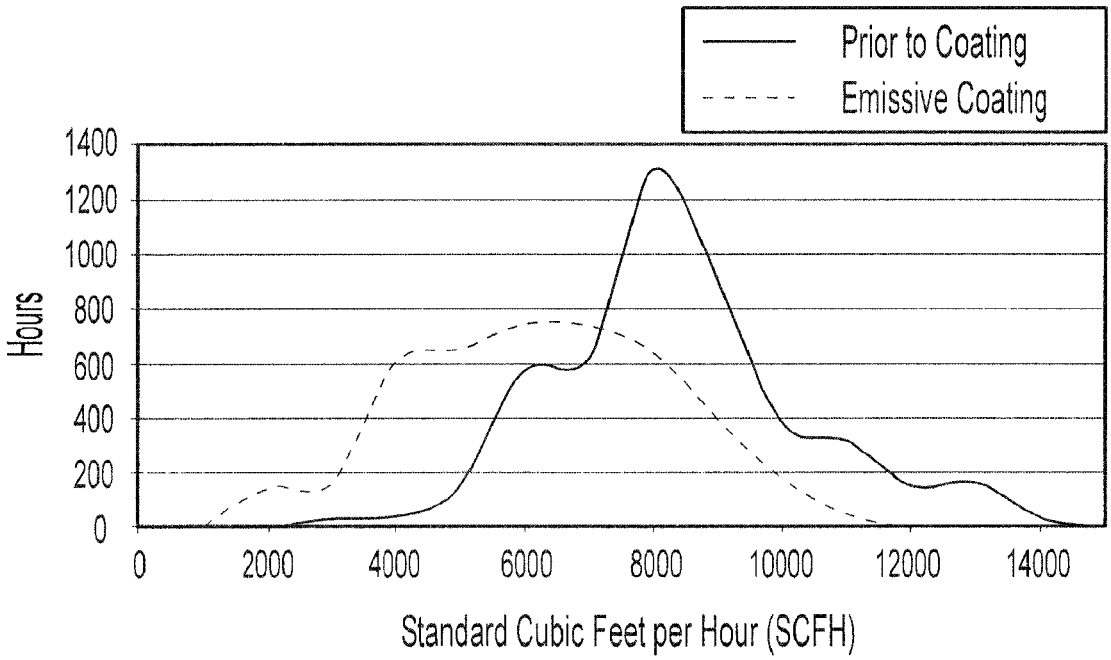
FIG. 3 is a graph showing the hours spent at fuel flow rates averaged for five preheat units, both prior to application of an emissive coating and after application of an Emisshield emissive coating.

FIG. 3 is a graph that shows the hours spent at given fuel flow rates (rounded to the nearest 100 SCFH) while preheating ladles with all five trial preheat units. The graph shows the shift in the mean consumption rate of 8,200 SCFH prior to application of an emissive coating to a new mean consumption rate of 6,900 SCFH after application of the Emisshield emissive coating.

A more detailed fuel savings summary with the present method of refractory ladles is shown in Tables 3A, 3B and 3C below. These data were obtained by comparing gas consumption data for all five of the preheat units prior to application with the data for the five preheat units after application of the emissive coating to each of the preheat units. The total fuel consumed was then averaged by the total hours of temperature control during preheating for all of the preheat units during this period. This resulted in a base fuel consumption rate of 8,235 SCFH prior to application of the emissive coating, as shown in the last column of Table 3A below. The same method of combining fuel consumption data for all of the preheat units and averaging by the total hours of temperature control during preheating for all of the preheat units was applied to the data recorded after application of the Emisshield emissive coating. After application of the Emisshield emissive coating, the combined average consumption reduced to 6,900 SCFH, for an improved efficiency of 16%, as shown in the last column of Table 3A below. This confirms the shift in the mean fuel consumption rate and increased efficiencies shown in the graph of FIG. 2.

The findings in Tables 3A, 3B and 3C also show that when applied over a new refractory surface, as in preheat unit 1, the Emisshield emissive coating forming the radiant reflective surface more than doubled fuel consumption efficiency, compared to that realized by the other four preheat units.

Since the ITC-100 emissive coating trial (Table 3A and 3C) was for only three weeks and on only two preheat units with worn refractory surfaces, the performance of the ITC-100 emissive coating was not concluded less effective for improving fuel consumption efficiency than the Emisshield emissive coating. Rather, the total data in Tables 3A, 3B and 3C documented a 16% reduction in fuel usage for the present method of preheating steelmaking ladles (see bottom right of Table 3A below). That corresponds to an annual savings of 24,241 Million British Thermal Units (MMBTU) of fuel (see bottom row of Table 3B).

TABLE 3A

Average Fuel Consumptions for Individual Preheat Units,
Standard Non-Coated Refractory vs. Emisshield and ITC-100 Emissive Coatings
Emissivity Coating of Walls

| | EMISSHIELD WALL 1 Ave. SCFH | ITC 100 Wall 2 Ave. SCFH | EMISSHIELD Wall 3 Ave. SCFH | ITC 100 Wall 3 Ave. SCFH | EMISSHIELD Wall 3 Ave. SCFH | EMISSHIELD Wall 4 Ave. SCFH | EMISSHIED Wall 5 Ave. SCFH | EMISSHIELD All Walls Ave. SCFH |
|---|---|---|---|---|---|---|---|---|
| After Pyro's & Before Coating All Gaps | 7535 Jul. 23, 2006-Aug. 19, 2006 | 7912 Jul. 23, 2006-Dec. 6, 2006 | 7912 Jul. 23, 2006-Dec. 6, 2006 | 9045 Jul. 23, 2006-Dec. 6, 2006 | 9045 Jul. 23, 2006-Dec. 6, 2006 | 8260 Jul. 23, 2006-Dec. 21, 2006 | 8881 Jul. 23, 2006-Dec. 21, 2006 | 8235 Ave. for All Units Over All Days Without Coating |
| After Pyro's & After Coation All Gaps | 5148 Aug. 20, 2006-Feb. 28, 2007 | 7582 Dec. 7, 2006-Dec. 20, 2006 | 7005 Dec. 21, 2006-Feb. 28, 2007 | 8259 Dec 7, 2006-Dec. 20, 2006 | 7894 Dec. 21, 2006-Feb. 28, 2007 | 7392 Dec. 21, 2006-Feb. 28, 2007 | 7954 Dec. 21, 2006-Feb. 28, 2007 | 6900 Ave. for All Units Over All Days After Coating |
| Before-After | 31.7% | 4.2% | 11.5% | 8.7% | 12.7% | 10.5% | 10.4% | 16.2% |

TABLE 3B

Annualized Fuel Consumption Savings for Emisshield Emissive Coating
EMISSHIELD Emissivity Coating of Walls

| | Savings/ Control Hour (SCFH) | Control Hours/ Week | Savings/ Week (SCF) | Savings/ Year (SCF) | Savings/ Year (MMBtu) | Nominal Cost NatGas/ MMBtu | Projected Cost Savings/ Year | If All Walls Had Same % Savings |
|---|---|---|---|---|---|---|---|---|
| Unit 1 Savings | 2387 | 87.5 | 208901 | 10862843 | 10989 | $7.00 | $76,920 | $331,481.08 |
| Unit 2 Savings | 907 | 87.7 | 79500 | 4133998 | 4182 | $7.00 | $29,273 | $119,922.36 |
| Unit 3 Savings | 1151 | 80.6 | 92835 | 4827414 | 4883 | $7.00 | $34,183 | $133,195.43 |

TABLE 3B-continued

| Annualized Fuel Consumption Savings for Emisshield Emissive Coating EMISSHIELD Emissivity Coating of Walls | | | | | | | | |
|---|---|---|---|---|---|---|---|---|
| | Savings/ Control Hour (SCFH) | Control Hours/ Week | Savings/ Week (SCF) | Savings/ Year (SCF) | Savings/ Year (MMBtu) | Nominal Cost NatGas/ MMBtu | Projected Cost Savings/ Year | If All Walls Had Same % Savings |
| Unit 4 Savings | 868 | 53.6 | 46578 | 2422043 | 2450 | $7.00 | $ 17,150 | $110,017.19 |
| Unit 5 Savings | 927 | 35.6 | 33030 | 1717585 | 1737 | $7.00 | $ 12,162 | $109,246.86 |
| Savings All Units Total | 1335 | 345.1 | 460844 | 23963883 | 24241 | $7.00 | $169,688 | |

TABLE 3C

| Annualized Fuel Consumption Savings for ITC-100 Emissive Coating ITC 100 Emissivity Coating of Walls | | | | | | | | |
|---|---|---|---|---|---|---|---|---|
| | Savings/ Control Hour (SCFH) | Control Hours/ Week | Savings/ Week (SCF) | Savings/ Year (SCF) | Savings/ Year (MMBtu) | Nominal Cost NatGas/ MMBtu | Projected Cost Savings/ Year | If All Walls Had Same % Savings |
| Unit 2 Savings | 330 | 87.7 | 28923 | 1504005 | 1521 | $7.00 | $10,650 | $43,629.40 |
| Unit 3 Savings | 786 | 80.6 | 63416 | 3297657 | 3336 | $7.00 | $23,351 | $90,987.19 |

Further efficiency in fuel consumption was found to be achieved by limiting a size of the flame 144 when the preheater 108 is in a low fire or idle state between ladle preheating cycles.

Preheat units often use ball valves throttled by linkage from externally mounted motors to control the flow rate of the fuel (e.g., natural gas). A problem I found with this design is that there is an inconsistent relationship between the fuel flow rate and a valve actuator motor position used as feedback to a control system of the preheat unit. This inconsistent relationship resulted in a minimum valve position for the fuel flow rate when idle, e.g., 600 SCFH, and may result in fuel flow rates of 1,200 to 2,000 SCFH for the same motor and linkage position.

By way of analysis, total fuel consumed when not preheating a ladle was recorded (as idle flame consumption) in units of standard cubic feet (SCF) for each of aforementioned preheat units (numbered 1-5). This consumption was averaged by days of operation to arrive at a daily idle flame consumption rate of SCF per Day.

For the trial, four of the five preheat units (i.e., preheat units 2-5) were modified to direct drive throttle valves 121 to control flow for gas, oxygen, and combustion air. As each preheat unit was modified, its new idle flame gas consumption was recorded for comparison of daily rates. Preheat unit 5 was modified on Sep. 14, 2006; preheat unit 4 was modified on Nov. 23, 2006; preheat unit 3 was modified on Jan. 8, 2007; and preheat unit 2 was modified on Feb. 13, 2007. Preheat unit 1 underwent its upgrade on Mar. 8, 2007 after the data for this study was compiled.

Average daily consumption to maintain an idle flame was 9,005 SCF per day per preheat unit across all of the preheat units when using the original control valves (see Row 2, Column 2 of Table 4 below). The target for fuel savings was to reduce daily idle consumption by 66% from the daily idle consumption resulting from use of the original valve control. In this trial, the actual results exceeded this target. Idle flame gas consumption was reduced to 2,446 SCF per day per preheat unit across the four units modified during the course of the study (see Row 3, Column 2 of Table 4 below). This marked a 73% reduction, saving 12,108 MMBTU of natural gas per year.

TABLE 4

| Daily and Annual Fuel Consumption Savings with Control Valve Upgrade | | |
|---|---|---|
| | Idle Flame Reduction Trial | |
| | Idle Flame SCF/Wall-Day | MMBTU Idle Usage/Year |
| Old Controls All Walls | 9005 | 16623 |
| New Controls Wall 4 & 5 (Nov. 23, 2006), Wall_3_(Jan. 7, 2007), Wall_2_(Feb. 12, 2007) | 2446 | 4515 |
| Percent Reduction in Gas Consumption | 73% | |
| Annual Savings All Units: MMBTU | 12108 | |
| Cost/MMBTU | $ 7.00 | |
| Annual Savings: $ | $84,755.71 | |

The three trials described confirm the merits of the present method of preheating of steelmaking ladles. The method of preheating a steelmaking ladle efficiently measured and controlled the heating temperature of the refractories of the steelmaking ladle without overheating them, and increased the efficiency of the preheating process by reducing the fuel consumed by the preheater during the preheating process. Further, the improved valve control for burner flame further reduce fuel consumption between ladle preheat cycles.

In short, the present substantially reduced fuel costs in preheating ladles and more accurately and directly controlling refractory temperatures of the ladle refractories to avoid overheating. Extended refractory life resulted in further reducing operational costs, and lessened the impact on the environment by minimizing refractory waste generated each year.

The above description of specific embodiments has been given by way of example. From the disclosure given, those skilled in the art will not only understand the general inventive concept and its attendant advantages, but will also find apparent various changes and modifications to the structures and methods disclosed. It is sought, therefore, to cover all such changes and modifications as fall within the spirit and scope of the general inventive concept, as defined by the appended claims and equivalents thereof.

What is claimed is:

1. A preheater apparatus comprising:

a wall with an opening having at least a first side and at least a second side, and sized for positioning adjacent an opening of a steelmaking ladle;

a heating unit operatively coupled to the wall to allow heat from the heating unit to pass through the opening of the wall; and a radiant reflective surface operatively coupled to at least a portion of the first side of the wall, wherein the reflective surface on at least the portion of the first side of the wall facing the opening of the steelmaking ladle facilitates preheating the steelmaking ladle prior to molten metal being transferred into the steelmaking ladle.

2. The preheater apparatus of claim 1, further comprising:

a pyrometer operatively coupled to the wall, wherein the pyrometer measures a representative temperature of an inner refractory surface of the steelmaking ladle during preheating.

3. The preheater apparatus of claim 1, further comprising:

a direct drive throttle, wherein the direct drive throttle regulates a flow rate of fuel, air, and oxygen to the heating unit during an idle state of the heating unit between preheating cycles.

4. The preheater apparatus of claim 1, wherein the radiant reflective surface comprises an emissive coating.

5. The preheater apparatus of claim 4, wherein the emissive coating is a silicide coating.

6. The preheater apparatus of claim 5, wherein the silicide coating is selected from the group consisting of molybdenum silicide, tantalum silicide, niobium silicide and a combination thereof

7. The preheater apparatus of claim 1, wherein the radiant reflective surface comprises the emissive coating disposed on a refractory surface of the preheater.

8. A preheater apparatus comprising:

a heating unit;

a wall comprising a radiant reflective surface with an emissive coating on at least a portion of the wall, wherein the heating unit is operatively coupled to the wall, and the wall is sized for positioning adjacent an opening of a steelmaking ladle; and wherein the preheater apparatus is configured to preheat the steelmaking ladle prior to molten metal being transferred into the steelmaking ladle.

9. The preheater apparatus of claim 8, further comprising:

a pyrometer operatively coupled to the wall, wherein the pyrometer measures a representative temperature of an inner refractory surface of a steelmaking ladle during preheating.

10. The preheater apparatus of claim 8, further comprising:

a direct drive throttle, wherein the direct drive throttle regulates a flow rate of fuel, air, and oxygen to the heating unit during an idle state of the heating unit between preheating cycles.

11. The preheater apparatus of claim 8, wherein the emissive coating is a silicide coating.

12. The preheater apparatus of claim 11, wherein the silicide coating is selected from the group consisting of molybdenum silicide, tantalum silicide, niobium silicide and a combination thereof.

13. The preheater apparatus of claim 8, wherein the radiant reflective surface comprises the emissive coating disposed on a refractory surface of the preheater.

14. A preheater apparatus comprising:

a heating unit;

a direct drive throttle valve operatively coupled to the heating unit, wherein the direct drive throttle valve regulates a flow rate of fuel, air, and oxygen to the heating unit; and wherein the preheater apparatus is configured to preheat a steelmaking ladle.

15. The preheater apparatus of claim 14 further comprising:

a wall comprising a radiant reflective surface on at least a portion of the wall, wherein the wall is operatively coupled to the heating unit.

16. The preheater apparatus of claim 15, further comprising:

a pyrometer operatively coupled to the wall, wherein the pyrometer measures a representative temperature of an inner refractory surface of the steelmaking ladle during preheating.

17. The preheater apparatus of claim 15, wherein the radiant reflective surface comprises an emissive coating.

18. The preheater apparatus of claim 17, wherein the emissive coating is a silicide coating.

19. The preheater apparatus of claim 18, wherein the silicide coating is selected from the group consisting of molybdenum silicide, tantalum silicide, niobium silicide and a combination thereof.

20. The preheater apparatus of claim 15, wherein the radiant reflective surface comprises the emissive coating disposed on a refractory surface of the preheater.

* * * * *